US009211631B2

(12) United States Patent
Kim et al.

(10) Patent No.: US 9,211,631 B2
(45) Date of Patent: Dec. 15, 2015

(54) GRINDING WHEEL TRUING TOOL AND MANUFACTURING METHOD THEREOF, AND TRUING APPARATUS, METHOD FOR MANUFACTURING GRINDING WHEEL AND WAFER EDGE GRINDING APPARATUS USING THE SAME

(75) Inventors: Yong-Dug Kim, Gumi-si (KR); Gye-Je Cho, Gumi-si (KR); Mun-Suk Yong, Gumi-si (KR); Hwan-Yun Jung, Gumi-si (KR); Kyung-Moo Lee, Gumi-si (KR); Dong-Hwan Hyun, Chilgok-gun (KR); Jae-Young Kim, Mungyeong-si (KR)

(73) Assignee: Siltron, Inc., Gumi (KR)

( * ) Notice: Subject to any disclaimer, the term of this patent is extended or adjusted under 35 U.S.C. 154(b) by 920 days.

(21) Appl. No.: 13/442,584

(22) Filed: Apr. 9, 2012

(65) Prior Publication Data

US 2012/0233930 A1 Sep. 20, 2012

Related U.S. Application Data

(62) Division of application No. 12/332,136, filed on Dec. 10, 2008, now Pat. No. 8,398,464.

(30) Foreign Application Priority Data

Dec. 14, 2007 (KR) ..... 10-2007-0131306

(51) Int. Cl.

| | |
|---|---|
| ***B24B 53/07*** | (2006.01) |
| ***B24B 9/06*** | (2006.01) |
| ***B24D 18/00*** | (2006.01) |

(52) U.S. Cl.
CPC ..... *B24B 53/07* (2013.01); *B24B 9/065* (2013.01); *B24D 18/00* (2013.01)

(58) Field of Classification Search
CPC ..... B24B 53/07; B24B 53/14; B24B 9/065; B24B 51/00; B24D 18/00; G05B 2219/45161; G05B 2219/35222; G05B 19/4069; G05B 19/4097
USPC ..... 700/96, 164, 182
See application file for complete search history.

(56) References Cited

U.S. PATENT DOCUMENTS 4,457,113 A 7/1984 Miller
5,184,426 A * 2/1993 Minatani ..... 451/5

(Continued)

FOREIGN PATENT DOCUMENTS

EP 0 904 893 3/1999
JP 2007-44817 2/2007

(Continued)

*Primary Examiner* — Mohammad Ali
*Assistant Examiner* — Nathan L Laughlin
(74) *Attorney, Agent, or Firm* — Greer Burns & Crain Ltd.

(57) ABSTRACT

The present invention relates to a grinding wheel truing tool, its manufacturing method, and a truing apparatus, a method for manufacturing a grinding wheel and a wafer edge grinding apparatus using the same. The grinding wheel truing tool of the present invention compensates a groove of a fine-grinding wheel for fine-grinding a wafer edge, and includes a truer having an edge of the same angle as a slanted surface of the groove of the fine-grinding wheel and a cross-sectional shape corresponding to a cross-sectional shape of the groove. The present invention uses the truing tool to easily process the groove of the grinding wheel for fine-grinding the wafer edge.

3 Claims, 18 Drawing Sheets

(56) References Cited

U.S. PATENT DOCUMENTS

| | | | | |
|---|---|---|---|---|
| 7,189,149 | B2 * | 3/2007 | Katayama et al. | 451/56 |
| 2009/0163119 | A1 | 6/2009 | Yamazaki et al. | |

FOREIGN PATENT DOCUMENTS

| | | |
|---|---|---|
| KR | 10-2008-0062660 | 7/2008 |
| WO | WO 2007/069629 | 6/2007 |

* cited by examiner (a)

(b)

(a)

(b)

GRINDING WHEEL TRUING TOOL AND MANUFACTURING METHOD THEREOF, AND TRUING APPARATUS, METHOD FOR MANUFACTURING GRINDING WHEEL AND WAFER EDGE GRINDING APPARATUS USING THE SAME

This is a divisional of application Ser. No. 12/332,136, filed Dec. 10, 2008.

FIELD OF THE INVENTION

The present invention relates to a grinding wheel truing tool, its manufacturing method, and a truing apparatus, a method for manufacturing a grinding wheel and a wafer edge grinding apparatus using the same, and in particular, to a grinding wheel truing tool, its manufacturing method, and a truing apparatus, a method for manufacturing a grinding wheel and a wafer edge grinding apparatus using the same that can easily form or compensate a groove of a wafer edge grinding wheel to improve durability of the grinding wheel and process a wafer edge in conformity with quality specifications.

BACKGROUND OF THE INVENTION

In general, a technology for grinding a round of an edge of a semiconductor wafer includes vertical grinding and helical grinding. The vertical grinding technology rotates a grinding wheel having a groove on a level with a surface of a semiconductor wafer, contacts a surface of the groove with an edge of the semiconductor wafer and grinds the edge of the semiconductor wafer using shape and roughness of the groove. The helical grinding technology rotates a grinding wheel having a groove at a predetermined angle relative to a surface of a semiconductor wafer, contacts a surface of the groove with an edge of the semiconductor wafer and grinds the edge of the semiconductor wafer.

In grinding an edge of a semiconductor wafer using the above-mentioned technology, a grinding wheel has a groove, of which shape corresponds to that of the edge of the semiconductor wafer, in conformity with the predetermined quality specifications.

The grinding wheel, in particular, the groove is made of a metal bond or a resin bond.

A grinding wheel having a metal bond groove has excellent wear resistance, and thus, although the number of times of wafer edge grinding increases, the grinding wheel suffers a little change in shape of the groove caused by wear and eliminates the need to true or dress the groove during wafer edge grinding. However, the grinding wheel having the metal bond groove forms a damaged layer of a predetermined depth from the surface of the wafer edge and generates a fine scratch such as a wheel mark on the surface of the wafer edge, and thus does not meet customer demands for wafer surface quality.

And, a grinding wheel having a resin bond groove guarantees a good grinding quality, but has a slow grinding speed and a poor wear resistance of the groove, and consequently suffers a change in shape of the groove during wafer edge grinding. Thus, the resin bond groove needs truing or dressing in a predetermined cycle. In particular, in the case that a helical grinding technology is applied, wafer edge grinding is complicated, a diameter of the grinding wheel is limited due to a wheel balance problem and life of a spindle is reduced.

Here, 'truing' means, when the shape of a groove of a grinding wheel is changed, restoring the shape of the groove using a truing tool (hereinafter referred to as a truer, and a conventional truer has similar thickness and diameter to a wafer) having an edge of a shape corresponding to a standard shape of the groove. 'Dressing' means removing grinding swarf that may be loaded in between exposed grits of a truer, and removing chips caught in exposed pores using a diamond dresser to expose new grits to the surface, thereby restoring a grinding performance.

A conventional wafer edge grinding process performs double grinding that grinds (rough-grinds) a considerable amount of edge of a semiconductor wafer using a grinding wheel having a metal bond groove and then grinds (fine-grinds) the edge of the semiconductor wafer using a grinding wheel having a resin bond groove to remove a fine scratch such as a wheel mark. This process can simultaneously make up for grinding quality reduction pointed out as a disadvantage of the metal bond groove, and life reduction caused by a low wear resistance, pointed out as a disadvantage of the resin bond groove.

A conventional wafer edge grinding apparatus is described with reference to FIGS. 1 to 5. FIG. 1 is a view illustrating a notch and a round of a wafer edge.

Referring to FIGS. 2 to 5, the conventional wafer edge grinding apparatus 10 includes a chuck operating unit 20 for fixing and rotating a wafer W, a grinding wheel 30 for grinding an edge of the wafer W, and a truer S for truing grooves 32' and 34' of the grinding wheel 30. At this time, the grinding wheel 30 includes rough-grinding wheels 31 and 33 having metal bond grooves for rough-grinding a notch and a round of the wafer W, and fine-grinding wheels 32 and 34 having resin bond grooves for fine-grinding a notch and a round of the wafer W. Specifically, the rough-grinding wheels 31 and 33 include a round rough-grinding wheel 31 for rough-grinding a round of the wafer W, and a notch rough-grinding wheel 33 for rough-grinding a notch of the wafer W. The fine-grinding wheels 32 and 34 include a notch fine-grinding wheel 32 for fine-grinding a notch of the wafer W, and a round fine-grinding wheel 34 for fine-grinding a round of the wafer W. At this time, the round fine-grinding wheel 34 is slanted at a predetermined angle, and thus it is also referred to as a helical wheel.

The grinding wheel 30 rotates in the direction equal or opposite to a rotation direction of the wafer W, and contacts with the edge of the wafer W to grind the edge of the wafer W using shape and roughness of the groove.

Meanwhile, because the grooves 32' and 34' of the notch fine-grinding wheel 32 and the round fine-grinding wheel 34 are worn down after a predetermined time passes by or grinding a predetermined number of wafers, the worn grooves 32' and 34' should be trued. The truing is made by the truer S having shape and dimension corresponding to thickness and diameter of the wafer W.

A wafer edge grinding process using the grinding apparatus 10 and a truing process using the truer S are described as follows.

According to the wafer edge grinding process, first, center, thickness and notch of a wafer W are measured. Next, the wafer W is loaded on a rotatable chuck 21 (mounted on a processing stage), and a round of the wafer W is rough-ground. Subsequently, a notch of the wafer W is rough-ground and fine-ground, and the round of the wafer W is fine-ground. Finally, the wafer W is unloaded.

According to the truing process, center and thickness of the truer S are measured. Next, the truer S is mounted on the chuck 21, and compensated by a truer compensating tool embedded in the round rough-grinding wheel 31. The groove 32' of the notch fine-grinding wheel 32 or the groove 34' of the round fine-grinding wheel 34 is selectively trued by the compensated truer S.

As shown in FIG. 4, the notch fine-grinding wheel 32 has a plurality of grooves 32' on the surface thereof. The grooves 32' fine-grind the wafer W. The grooves 32' are trued by the truer S. The notch fine-grinding wheel 32 grinds upper and lower slanted surfaces of the edge of the wafer W separately, and uses an air bearing with a spindle mounting the wheel 32. Due to these characteristics, when the number of times of wafer edge processing and truing exceeds a predetermined number, a wear unbalance phenomenon occurs to the notch fine-grinding wheel 32. The wear unbalance phenomenon is resulted from an increase in grinding amount by a volume indicated by diagonal lines (see FIG. 4(*a*)) when grinding the lower slanted surface of the edge of the wafer W. An alternate processing is used to minimize the wear unbalance of an equipment itself. The alternate processing grinds a lower slanted surface of an edge of a first wafer W, and then grinds an upper slanted surface (see FIG. 4(*b*)) of an edge of a second wafer W. The alternate processing alternates a processing sequence to balance a grinding amount, thereby reducing wear unbalance. However, in spite of use of the alternate processing, a wear unbalance phenomenon still occurs due to characteristics of a bearing with a spindle. As a result, as shown in FIG. 6, a notch of the first wafer W and a notch of the second wafer W are formed in different shapes. That is, there is a predetermined difference in grinding amount between a wafer of an odd number and a wafer of an even number, resulting in wear unbalance.

The round fine-grinding wheel 34 has a spindle mounted at a predetermined angle, for example 8°. When the round fine-grinding wheel 34 or its groove 34' is replaced by a new one, a new groove has a shape that is not in conformity with the shape quality specification. Thus, after the round fine-grinding wheel 34 or its groove 34' is replaced by a new one, a new groove should be trued by the truer S. If the new groove is not trued, because an edge of a wafer W is ground by a groove that is not in conformity with the shape quality specification, the edge of the wafer W has a shape that does not meet the shape quality specification as shown in FIG. 7, and consequently the wafer W is regarded as a faulty product. Therefore, after a grinding wheel or its groove is replaced by a new one, a new groove should be trued by the truer S to meet the shape quality specification for wafer edge.

However, as shown in FIG. 8, as the number of times of wafer edge grinding and truing by the truer S increases, the groove 34' is worn down and a wheel diameter at the groove 34' is reduced. When a wear amount reaches a predetermined amount (1 mm in radius, 30 times of truings), the use of the corresponding groove 34' is stopped to prevent an over-grinding phenomenon that the wafer edge is over-ground, and the groove 34' or the grinding wheel 34 is replaced by a new one. Although there is a small room for grinding due to difference in thickness between the truer S and the wafer W, an over-grinding phenomenon may occur due to a small change in Z-axis or flatness of a wafer or a small change in flatness of a chuck that may be caused by impurities on the surface of the chuck. This is why a grinding wheel or its groove is replaced by a new one.

The over-grinding problem generally comes to the notch fine-grinding wheel 32 and the round fine-grinding wheel 34. The over-grinding is recognized by an edge profiler or a microscope with a scale. The upper and lower bevel values are measured, in the case that the values exceed a predetermined range, it is determined as over-grinding, and a subsequent process is performed, for example the grooves 32' and 34' or the grinding wheels 32 and 34 are replaced. Even though a considerable portion of a resin bond groove is available, a grinding wheel is replaced, resulting in life reduction of the grinding wheel.

Meanwhile, the truer S is manufactured by powder-sintering ceramics as a basic material and various indispensable impurities (including diamond particles). The truer S is useful for truing of a groove, however it wears down a portion of the grinding wheels 32 and 34 slightly during truing, resulting in change in grinding dimension of the wafer W. After truing, it requires the time to set the wafer processing conditions.

The fine-grinding wheels 32 and 34 are manufactured by sintering diamond particles and a thermosetting resin such as a phenol resin or a polyamide resin. The thermosetting resin acts as a bond. During wafer edge grinding, the round fine-grinding wheel 34 is rotated at a high speed, for example, at a linear velocity of about 5000 m/min (about 30000 rpm to 40000 rpm), and the notch fine-grinding wheel 32 is rotated at a high speed, for example, at a linear velocity of about 500 m/min (about 150000 rpm). At this time, a friction heat is not removed due to outer environmental cause, resulting in a burning phenomenon. The groove of the grinding wheel is burned and hardened due to characteristics of a thermosetting resin. The burned portion is not removed by the truer S. And, if a wafer is ground by the burned grinding wheel, the diamond particles cannot work on the wafer due to the hardened resin bond groove, and consequently the wafer edge is not ground. That is, the burned grinding wheel cannot be restored or used due to a material of the truer and impossibility of wafer edge grinding, and thus the grinding wheel should be replaced. As mentioned above, this leads to life reduction of the grinding wheel.

SUMMARY OF THE INVENTION

The present invention is designed to solve the above-mentioned problems. Therefore, it is an object of the present invention to provide a grinding wheel truing tool, its manufacturing method, and a truing apparatus, a method for manufacturing a grinding wheel and a wafer edge grinding apparatus using the same that changes a material and shape of a truer to allow easy formation and compensation of a groove of a grinding wheel, and uniformly compensates the groove to solve a wear unbalance problem and improve a usage life of the grinding wheel.

It is another object of the present invention to provide a grinding wheel truing tool, its manufacturing method, and a truing apparatus, a method for manufacturing a grinding wheel and a wafer edge grinding apparatus using the same that presets coordinates of a truer and a grinding wheel and applies the same standard dimension of grinding to allow systemic automation, thereby simplifying a wheel replacement work and reducing downtime at work.

To achieve the above-mentioned objects, the present invention does not provide a conventional single truer having the same shape as a wafer, but provides each truer for a notch fine-grinding wheel and a round fine-grinding wheel to form or reform each groove of the notch fine-grinding wheel and the round fine-grinding wheel.

That is, a truing tool of the present invention is configured to compensate a groove of a fine-grinding wheel for fine-grinding a wafer edge, and comprises a truer having an edge of the same angle as a slanted surface of the groove of the fine-grinding wheel and a cross-sectional shape corresponding to a cross-sectional shape of the groove.

The truer is a first truer configured to compensate a groove of a notch fine-grinding wheel for fine-grinding a notch of the wafer edge, and preferably, the first truer has an edge of a trapezoidal cross-sectional shape.

Preferably, a slanted surface of the edge of the first truer is extended such that a thickness of the first truer is larger than a width of the groove of the notch fine-grinding wheel.

Preferably, the first truer is a diamond wheel formed by electroplating or metal bonding.

To achieve the above-mentioned objects, another truer is a second truer configured to compensate a groove of a round fine-grinding wheel for fine-grinding a round of the wafer edge, and preferably, the second truer has an edge of a semicircular cross-sectional shape.

Preferably, a slanted surface of the edge of the second truer is extended such that a thickness of the second truer is larger than a width of the groove of the round fine-grinding wheel.

Preferably, the second truer is a diamond wheel formed by electroplating or metal bonding.

To achieve the above-mentioned objects, a method for manufacturing a grinding wheel truing tool, i.e., the second truer, includes (a) on a three-dimensional construction program, forming a groove in the shape of an edge of a completed wafer at a portion of an outer periphery of a cylindrical subject with a shape dimension of a round fine-grinding wheel having no groove, the cylindrical subject having a central axis slanted at a predetermined angle; (b) through computer simulation, rotating the cylindrical subject based on the central axis to expand the wafer edge-shaped groove along the outer periphery of the cylindrical subject; (c) obtaining a shape dimension of the expanded groove as a shape dimension of an edge of a second truer; and (d) manufacturing a second truer using the obtained shape dimension.

At this time, in the step (c), the shape dimension of the edge of the second truer is preferably obtained by extending a slanted surface of the expanded groove along the slanted surface such that a thickness of the second truer is larger than a width of the groove.

Meanwhile, preferably the step (d) manufactures the second truer as a diamond wheel by electroplating or metal bonding.

To achieve the above-mentioned objects, a truing apparatus includes a first truer configured to compensate a groove of a notch fine-grinding wheel for fine-grinding a notch of a wafer edge, the first truer having an edge of the same angle as a slanted surface of the groove of the notch fine-grinding wheel and a cross-sectional shape corresponding to a cross-sectional shape of the groove of the notch fine-grinding wheel, the cross-sectional shape of the edge of the first truer being a trapezoid; and a second truer configured to compensate a groove of a round fine-grinding wheel for fine-grinding a round of a wafer edge, the second truer having an edge of the same angle as a slanted surface of the groove of the round fine-grinding wheel and a cross-sectional shape corresponding to a cross-sectional shape of the groove of the round fine-grinding wheel, the cross-sectional shape of the edge of the second truer being a semicircle.

To achieve the above-mentioned objects, a method for manufacturing a wafer edge grinding wheel manufactures a notch fine-grinding wheel by forming a groove along an outer periphery of the notch fine-grinding wheel having no groove using the above-mentioned first truer.

To achieve the above-mentioned objects, a method for manufacturing a wafer edge grinding wheel manufactures a round fine-grinding wheel by forming a groove along an outer periphery of the round fine-grinding wheel having no groove using the above-mentioned second truer.

To achieve the above-mentioned objects, a wafer edge grinding apparatus includes a chuck configured to mount and rotate a wafer; a grinding wheel configured to grind an edge of the wafer, and including a round rough-grinding wheel, a notch rough-grinding wheel, a notch fine-grinding wheel and a round fine-grinding wheel, each having a groove; a grinding operation unit configured to mount and rotate the grinding wheel and move the grinding wheel to contact the groove of the grinding wheel with the edge of the wafer mounted on the chuck; a first truer having an edge of a cross-sectional shape corresponding to a cross-sectional shape of the groove of the notch fine-grinding wheel and configured to compensate the groove of the notch fine-grinding wheel; a second truer having an edge of a cross-sectional shape corresponding to a cross-sectional shape of the groove of the round fine-grinding wheel and configured to compensate the groove of the round fine-grinding wheel; and a truing operation unit configured to mount and rotate the first and second truers and move the first and second truers to contact the edges of the first and second truers with the groove of each grinding wheel on a level with the groove of each grinding wheel.

Preferably, a slanted surface of the edge of the first truer is extended such that a thickness of the first truer is larger than a width of the groove of the notch fine-grinding wheel, and a slanted surface of the edge of the second truer is extended such that a thickness of the second truer is larger than a width of the groove of the round fine-grinding wheel.

Preferably, each of the first truer and the second truer is a diamond wheel formed by electroplating or metal bonding.

Preferably, the wafer edge grinding apparatus further includes a control unit configured to predict wear of the groove of the grinding wheel from wafer edge processing results, set the number of times the groove is used and a process time, and in the case that wear of the groove is predicted from wafer edge processing results, or the number of times the groove is used reaches a preset number or the process time exceeds a preset time, stop grinding the wafer edge.

Preferably, in response to the stop of wafer edge grinding, the control unit controls the truing operation unit to contact the first truer or the second truer with the notch fine-grinding wheel or the round fine-grinding wheel, respectively, so as to compensate the groove of the fine-grinding wheel, or controls the grinding operation unit to contact the wafer edge with a groove of the notch fine-grinding wheel that is not worn or a groove of the round fine-grinding wheel that is not worn.

Preferably, the truing operation unit has a servo motor and an electronic scale for controlling a movement amount of the first truer and the second truer.

Meanwhile, the round fine-grinding wheel may be a helical wheel that is slanted at a predetermined angle and is rotated relative to a plane comprising a surface of the wafer.

In this case, the truing operation unit includes a first truing operation unit configured to mount the first truer on a level with the groove of the notch fine-grinding wheel, and rotate and move the first truer to contact the first truer with the groove of the notch fine-grinding wheel; and a second truing operation unit configured to mount the second truer on a level with the groove of the round fine-grinding wheel, and rotate and move the second truer to contact the second truer with the groove of the round fine-grinding wheel.

And, the grinding operation unit includes a first grinding operation unit configured to mount and rotate the notch rough-grinding wheel, the notch fine-grinding wheel and the round fine-grinding wheel; and a second grinding operation unit configured to mount and rotate the round rough-grinding wheel.

Meanwhile, the round fine-grinding wheel may be a vertical wheel that is mounted on a level with a plane comprising a surface of the wafer and is rotated.

In this case, the first truer and the second truer are preferably mounted parallel with each other on the same rotation axis in the truing operation unit.

And, the grinding operation unit includes a first grinding operation unit configured to mount and rotate the notch rough-grinding wheel and the notch fine-grinding wheel; and a second grinding operation unit configured to mount and rotate the round rough-grinding wheel and the round fine-grinding wheel.

At this time, the round rough-grinding wheel and the round fine-grinding wheel are preferably mounted parallel with each other on the same rotation axis in the second grinding operation unit.

Further, the round rough-grinding wheel and the round fine-grinding wheel are preferably formed integrally with each other.

DETAILED DESCRIPTION OF THE INVENTION

Hereinafter, preferred embodiments of the present invention will be described in detail with reference to the accompanying drawings. Prior to the description, it should be understood that the terms used in the specification and the appended claims should not be construed as limited to general and dictionary meanings, but interpreted based on the meanings and concepts corresponding to technical aspects of the present invention on the basis of the principle that the inventor is allowed to define terms appropriately for the best explanation. Therefore, the description proposed herein is just a preferable example for the purpose of illustrations only, not intended to limit the scope of the invention, so it should be understood that other equivalents and modifications could be made thereto without departing from the spirit and scope of the invention.

Meanwhile, to achieve the objects of the present invention, a truer has an edge of the same angle as a slanted surface of a groove of a wafer edge grinding wheel and a cross-sectional shape corresponding to a cross-sectional shape of the groove. The truer is configured to compensate grooves of a notch grinding wheel for grinding a notch of a wafer edge and a round grinding wheel for grinding a round of a wafer edge. That is, it should be understood that the truer includes a first truer S1 of FIG. 9 and a second truer S2 of FIG. 10 as described below.

Figure 9:
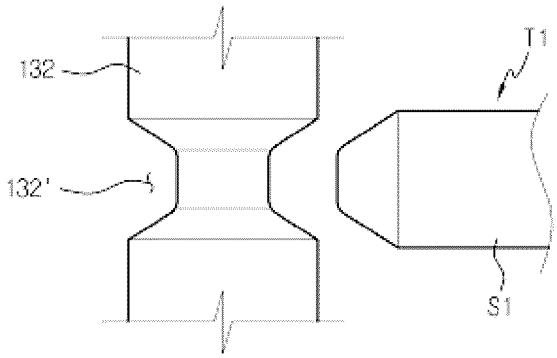
FIG. 9 is a partial side view of a truing tool for a notch fine-grinding wheel according to a preferred embodiment of the present invention.

FIG. 9 is a partial side view of a truing tool for a notch grinding wheel according to an embodiment of the present invention.

Referring to FIG. 9, the truing tool T1 comprises a first truer S1 configured to compensate a groove 132' of a notch grinding wheel 132 for grinding a notch of a wafer edge.

The first truer S1 has an edge of a cross-sectional shape corresponding to a cross-sectional shape of the groove 132' of the notch grinding wheel 132. As shown in FIG. 9, the edge of the first truer S1 has a trapezoidal cross-sectional shape. Specifically, the edge of the first truer S1 has the same angle as a slanted surface of the groove 132' of the notch grinding wheel 132. A slanted surface of the edge of the first truer S1 is extended such that a thickness of the first truer S1 is larger than a width of the groove 132' of the notch grinding wheel 132. Thus, although the groove 132' is compensated by the first truer S1, the slanted surface of the groove 132' has the same angle as before compensation. At this time, the thickness of the first truer S1 is larger than the width of the groove 132' to prevent an over-grinding phenomenon that a wafer edge over-rubs against upper and lower slanted surfaces of the groove 132', during wafer edge grinding using the notch grinding wheel 132.

Preferably, the first truer S1 is a diamond wheel formed by an electroplating or metal bonding method. That is, the truing tool T1 has a larger hardness than the resin bond groove 132' of the notch grinding wheel 132, and thus can easily compensate the groove 132' of the notch grinding wheel 132.

Figure 10:
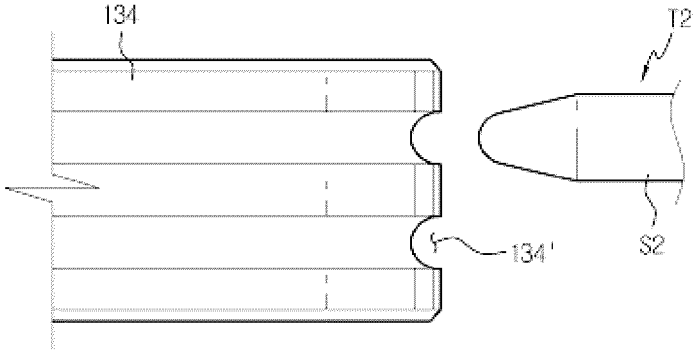
FIG. 10 is a partial side view of a truing tool for a round fine-grinding wheel according to a preferred embodiment of the present invention.

FIG. 10 is a partial side view of a truing tool for a round grinding wheel according to an embodiment of the present invention.

Referring to FIG. 10, the truing tool T2 comprises a second truer S2 configured to compensate a groove 134' of a round grinding wheel 134 for grinding a round of a wafer edge.

The second truer S2 has an edge of a cross-sectional shape corresponding to a cross-sectional shape of the groove 134' of the round grinding wheel 134. As shown in FIG. 10, the edge of the second truer S2 has a semicircular cross-sectional shape. Specifically, the edge of the second truer S2 has the same angle and radius of curvature as a groove compensated to meet the shape quality specifications for wafer edge processing using the groove 134' of the round grinding wheel 134. A slanted surface of the edge of the second truer S2 is extended such that a thickness of the second truer S2 is larger than a width of the groove 134' of the round grinding wheel 134. Therefore, although the groove 134' is compensated by the second truer S2, the slanted surface of the groove 134' has the same angle as before compensation. At this time, the thickness of the second truer S2 is larger than the width of the groove 134' to prevent an over-grinding phenomenon that a wafer edge over-rubs against upper and lower surfaces of the groove 134', during wafer edge grinding using the round grinding wheel 134.

Preferably, the second truer S2 is a diamond wheel formed by an electroplating or metal bonding method. That is, the truing tool T2 has a larger hardness than the resin bond groove 134' of the round grinding wheel 134, and thus can easily compensate the groove 134' of the round grinding wheel 134.

Meanwhile, for a target quality shape of a wafer edge, the truing tool T2 and the groove 134' of the round grinding wheel 134 compensated by the truing tool T2 should have a shape corresponding to the target quality shape of a wafer edge. In particular, in the case that a round grinding wheel is a helical wheel, the truing tool T2 for the round grinding wheel according to the present invention, i.e. the second truer S2 contacts the round grinding wheel with a wafer at a predetermined angle, in a different way from a conventional single truer (having the same shape dimension as a wafer and configured to contact a round grinding wheel with a wafer on a level with the wafer). As a result, a shape dimension of a groove of the round grinding wheel corresponds to those of the conventional single truer and the wafer, but is not the same as those of the conventional single truer and the wafer. And, a shape dimension of a groove of a new typical helical wheel does not correspond to that of a wafer edge. So, before use, the groove of the new helical wheel should be compensated. For this reason, in the case that the second truer of the present invention is manufactured according to a shape dimension of a groove of a conventional helical wheel, a groove of a helical wheel has a shape dimension not corresponding to a target quality shape of a wafer edge. A method for manufacturing the truing tool T2 for a grinding wheel is described with reference to FIG. 11.

The method for manufacturing the truing tool T2 for a grinding wheel according to the present invention includes obtaining a shape dimension of an edge of a second truer through computer simulation, and manufacturing a second truer using the obtained shape dimension.

Figure 11:
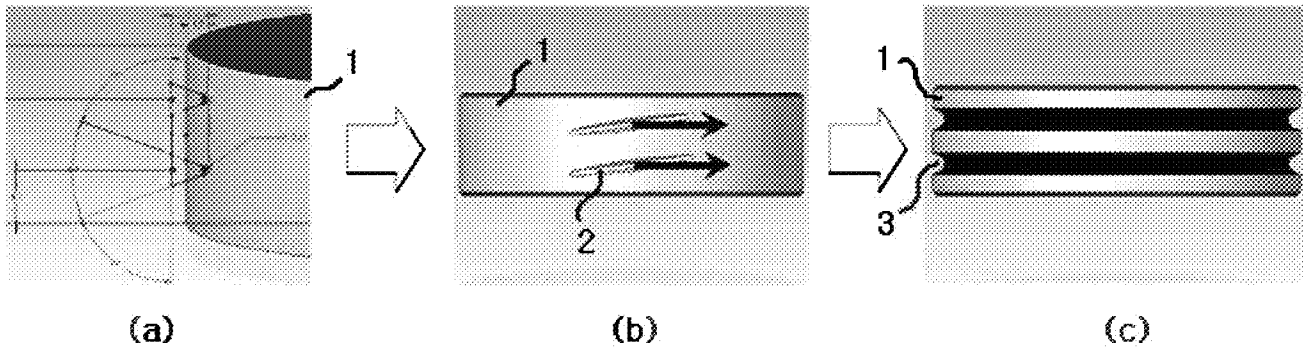
FIG. 11 is a view illustrating a method for manufacturing a second truer according to a preferred embodiment of the present invention.

Specifically, first, as shown in FIG. 11(*a*), a central axis of a cylindrical subject 1 having a shape dimension of a round grinding wheel having no groove is slanted at a predetermined angle on a three-dimensional construction program. In this state, a groove having a shape of an edge of a completed wafer is constructed on a portion of an outer periphery of the cylindrical subject 1. As shown in FIG. 11(*b*), the groove 2 is formed of a wafer edge slanted at a predetermined angle on a portion of an outer periphery of the cylindrical subject 1. Here, the three-dimensional construction program is a well-known program such as Auto CAD program or quick express editing program, and its description is herein omitted.

Subsequently, through computer simulation, the cylindrical subject 1 is rotated based on its central axis to expand the slanted groove 2 along the outer periphery of the cylindrical subject 1. As shown in FIG. 11(*c*), a groove 3 is formed to extend along the outer periphery of the cylindrical subject 1.

The shape dimension of the groove 3 extended along the outer periphery of the cylindrical subject 1 is obtained as a shape dimension of an edge of a second truer. That is, the shape dimension of the edge of the second truer can be obtained from radius of curvature and angle of the groove 3. At this time, it is preferable to obtain the shape dimension of the edge of the second truer by extending a slanted surface of the groove 3 along the slanted surface such that thickness of the second truer is larger than width of the groove 3.

Next, a second truer is manufactured using the obtained shape dimension. It is preferable to manufacture the second truer as a diamond wheel by an electroplating method or a metal bonding method.

Figure 12:
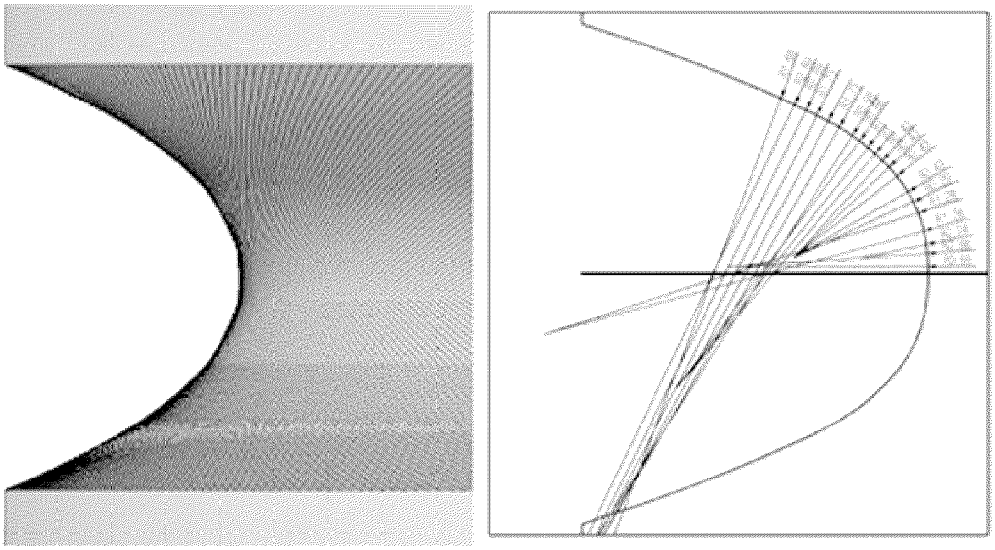
FIG. 12 is an example view illustrating layout of an edge of the second truer of FIG. 11 by approximating the edge of the second truer to a limited number of curves.

Further, the shape dimension of the edge of the second truer consists of an unlimited number of curves, and thus the shape dimension of the edge of the second truer is impracticable. However, it is possible to obtain a practicable shape dimension of the edge of the second truer by approximating the shape dimension of the groove 3 using a limited number curves (see FIG. 12). At this time, an allowance in design between a theoretical shape and an approximate shape of the second truer is set within a target shape dimension of a wafer edge.

The second truer is manufactured through the above-mentioned process to have a groove of a round grinding wheel of shape dimension corresponding to a target quality dimension of a wafer edge.

Although this embodiment shows the above-mentioned process obtains a shape dimension of an edge of a second truer and manufactures a second truer using the obtained shape dimension, the first truer S1 may be manufactured in the same way.

Figure 13:
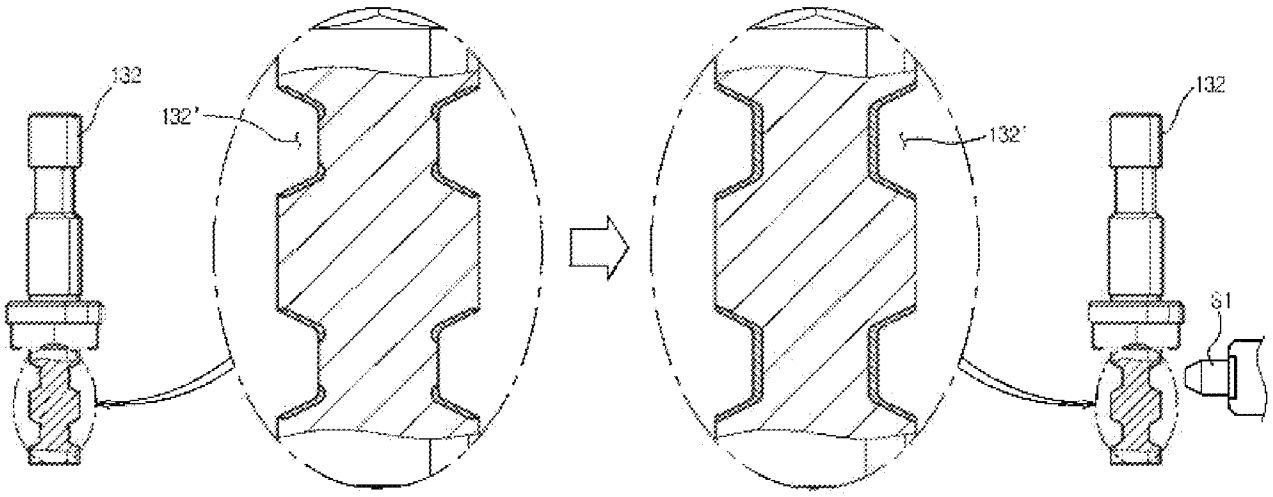
FIG. 13 is a view illustrating a process for compensating a groove of a notch fine-grinding wheel by the truing tool of FIG. 9.
Figure 14:
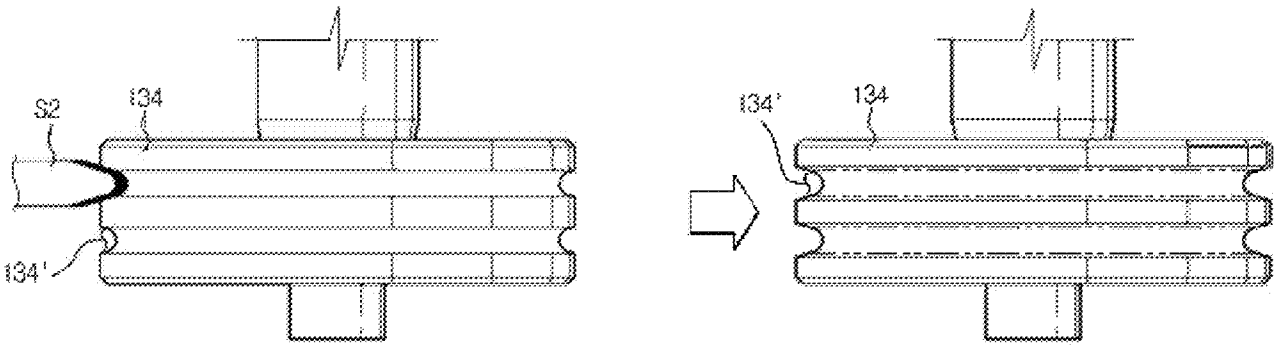
FIG. 14 is a view illustrating a process for compensating a groove of a helical wheel using the truing tool of FIG. 10.

As shown in FIGS. 13 and 14, the truing tools T1 and T2 are selectively used to compensate each groove 132' and 134' of the grinding wheels 132 and 134, grooves 132' and 134' can be easily compensated and an over-grinding problem can be solved to increase durability of the grinding wheels 132 and 134. In particular, the shapes of the grooves 132' and 134' of the grinding wheels 132 and 134 are restored to the original state by the truing tools T1 and T2 of the present invention, thereby solving an unbalanced shape problem in wafer edge processing.

Further, the truing tools T1 and T2 can compensate the grooves 132' and 134' of the grinding wheels 132 and 134 and form a groove on the surface of a grinding wheel having no groove. That is, the notch grinding wheel 132 can be manufactured by forming a groove along an outer periphery of the notch grinding wheel 132 having no groove using the first truer S1. The round grinding wheel 134 can be manufactured by forming a groove along an outer periphery of the round grinding wheel 134 having no groove using the second truer S2. According to the present invention, a wafer edge grinding apparatus 100 includes the truing tools T1 and T2, and compensates and forms the grooves 132' and 134' of the wafer edge grinding wheels 132 and 134. The wafer edge grinding apparatus 100 is described with reference to FIGS. 15 to 17.

Figure 15:
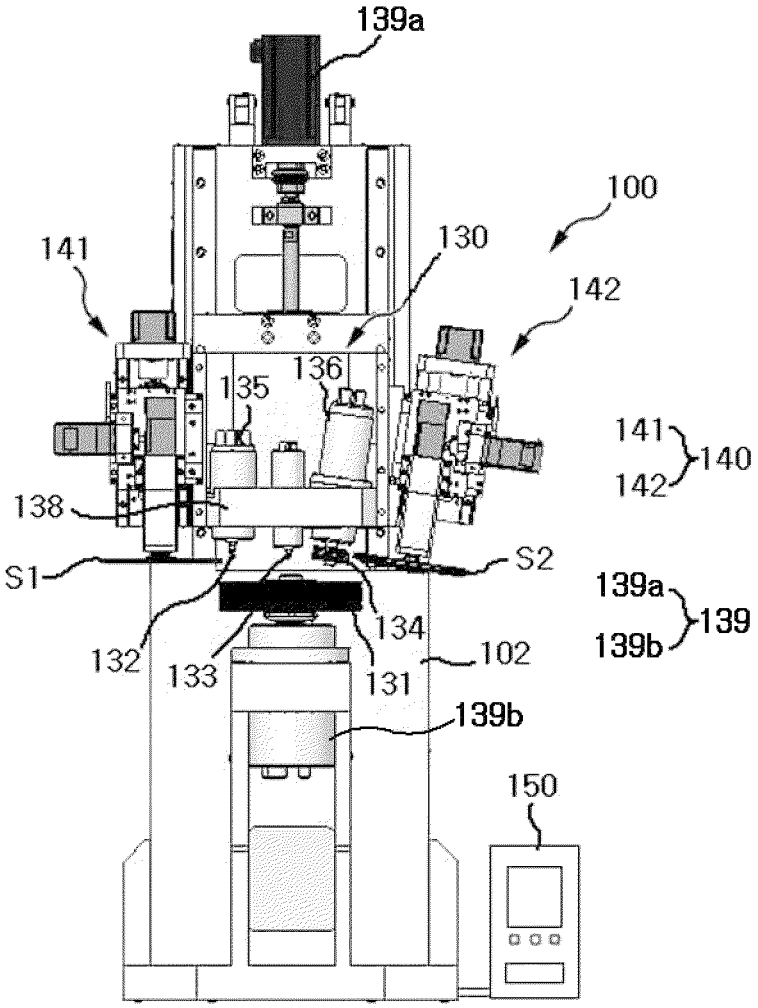
FIG. 15 is a view of a wafer edge grinding apparatus according to a preferred embodiment of the present invention.
Figure 16:
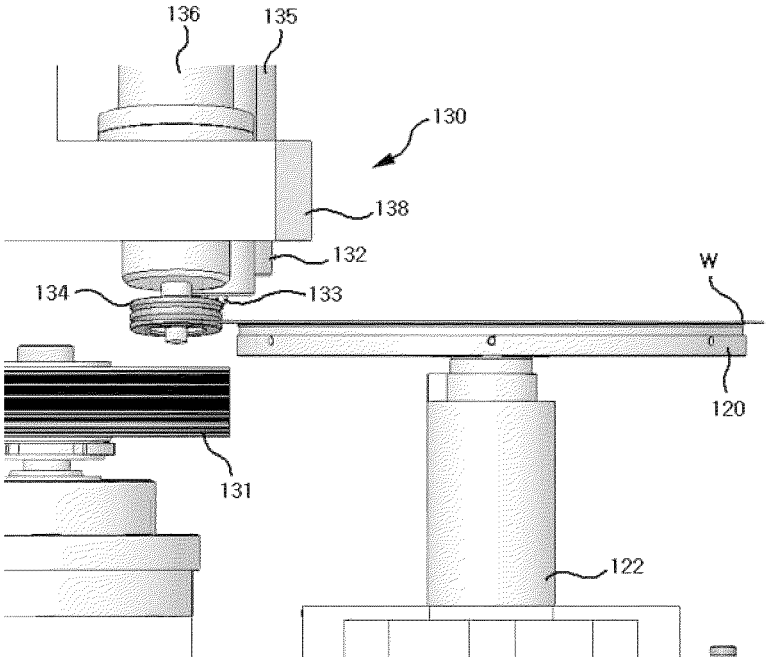
FIG. 16 is a partially enlarged side view of the wafer edge grinding apparatus according to a preferred embodiment of the present invention.
Figure 17:
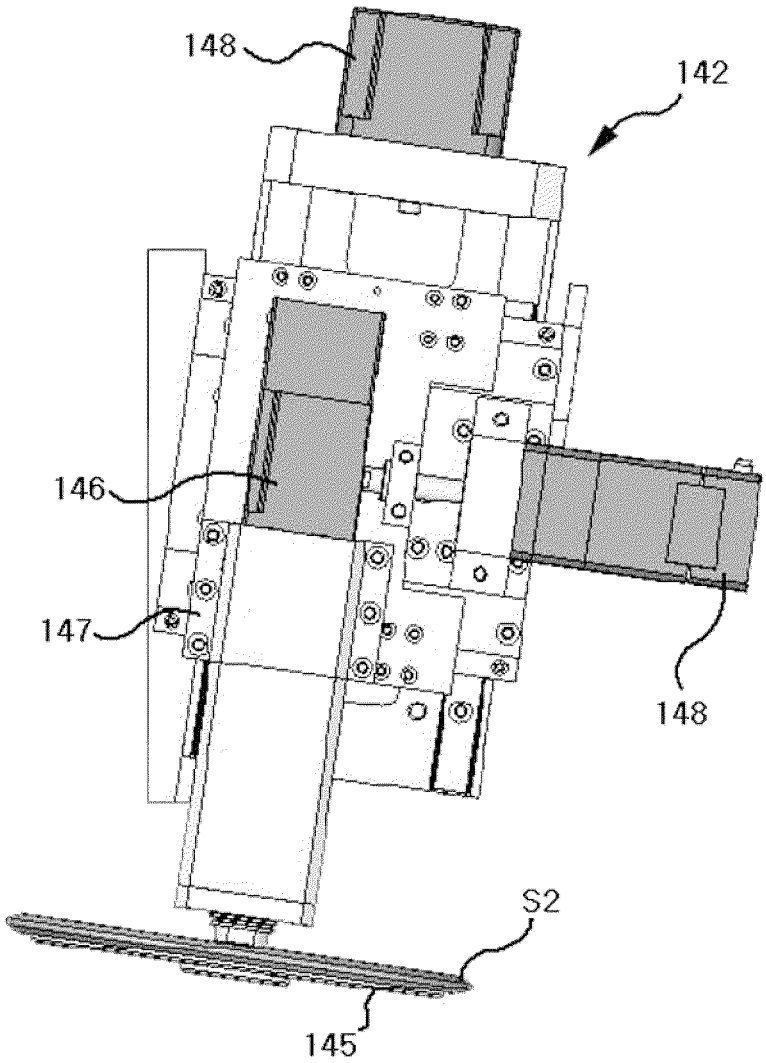
FIG. 17 is a view of a truing operation unit of the wafer edge grinding apparatus according to a preferred embodiment of the present invention.

Referring to FIGS. 15 to 17, the grinding apparatus 100 of the present invention includes a chuck 120 for mounting and rotating a wafer (W), a grinding wheel 130 for grinding an edge of the wafer (W), a grinding operation unit 139 for contacting the grooves 132' and 134' of the grinding wheel 130 with the wafer edge, a first truer S1 for compensating the groove 132' of the notch grinding wheel 132, a second truer S2 for compensating the groove 134' of the round grinding wheel 134, and a truing operation unit 140 for moving edges of the first truer S1 and the second truer S2 to contact the edges of the first truer S1 and the second truer S2 with the grooves 132' and 134' of the grinding wheel 130 on a level with the grooves 132' and 134' of the grinding wheel 130, respectively.

The chuck 120 is a vacuum chuck or an electrostatic chuck for mounting and fixing the wafer (W), and is rotated by a motor 122.

The grinding wheel 130 includes a round rough-grinding wheel 131, a notch rough-grinding wheel 133, a notch fine-grinding wheel 132 and a round fine-grinding wheel 134. As mentioned above, the round rough-grinding wheel 131 has a groove (not shown) for rough-grinding a round of a wafer edge, the notch rough-grinding wheel 133 has a groove (not shown) for rough-grinding a notch of a wafer edge, the notch fine-grinding wheel 132 has a groove (132' of FIG. 9) for fine-grinding a notch of a wafer edge, and the round fine-grinding wheel 134 has a groove (134' of FIG. 10) for fine-grinding a round of a wafer edge. A plurality of grooves 132' and 134' for fine-grinding the wafer edge are formed on the surfaces of the notch fine-grinding wheel 132 and the round fine-grinding wheel 134, respectively. At this time, the round fine-grinding wheel 134 is a helical wheel that rotates at a predetermined angle relative to a plane comprising the surface of the wafer (W).

The notch fine-grinding wheel 132 and the round fine-grinding wheel 134 are rotated by motors 135 and 136, respectively. The motors 135 and 136 each is installed and fixed to a wheel head assembly 138 that is installed in a frame 12 of the grinding apparatus 100. Although not shown, the round rough-grinding wheel 131 and the notch rough-grinding wheel 133 each is rotated by a motor. That is, the round rough-grinding wheel 131 and the notch rough-grinding wheel 133 are optionally rotated by the motors 135 and 136, and the wheel head assembly 138 having the grinding wheel 130 moves upwards and downwards by the grinding operation unit 139, so that the wheel grooves are contacted with the wafer edge. Specifically, the wheel head assembly 138 has the notch fine-grinding wheel 132, the notch rough-grinding wheel 133 and the round fine-grinding wheel 134 installed therein, and can be moved vertically by the grinding operation unit 139.

Here, the grinding operation unit 139 includes a first grinding operation unit 139*a* and a second grinding operation unit 139*b*.

The first grinding operation unit 139*a* operates the wheel head assembly 138 having the notch rough-grinding wheel 133, the notch fine-grinding wheel 132 and the round fine-grinding wheel 134 mounted therein to contact the wafer edge with any one groove of the notch rough-grinding wheel 133, the notch fine-grinding wheel 132 and the round fine-grinding wheel 134.

The first grinding operation unit 139*a* is a typical driving means that is moved by rotation of a belt, a pneumatic or hydraulic cylinder, a cam or a gear, for example a servo motor or a hydraulic motor, and is connected to the wheel head assembly 138 and drives the wheel head assembly 138. At this time, the wheel head assembly 138 moves tracing a straight or circular line in a side direction of the wafer edge to contact the wafer edge with the grooves 132' and 134' of the grinding wheel 130.

The second grinding operation unit 139*b* mounts and rotates the round rough-grinding wheel 131.

Meanwhile, when wafer edge grinding by the fine-grinding wheels 132 and 134 exceeds a predetermined number of times or a predetermined process time passes by, the grooves 132' and 134' of the fine-grinding wheels 132 and 134 of the grinding wheel 130 are compensated. At this time, a control unit 150 may be provided to predict wear of the grooves 132' and 134' of the fine-grinding wheels 132 and 134 from wafer edge processing results and to set the number of times the grooves 132' and 134' are used and a process time. Thus, in the case that over-grinding caused by wear of the grooves 132' and 134' is predicted, the number of times the wafer edge is ground (the number of times the grooves 132' and 134' are used) reaches a preset number, or the process time exceeds a preset time, the control unit 150 stops the wafer edge grinding and compensates the grooves 132' and 134'. The wear of the grooves 132' and 134' is predicted using wafer edge processing results or an optical sensor. Alternatively, the wear of the grooves 132' and 134' may be predicted using the number of times a groove is used or a process time that is arbitrarily set.

Meanwhile, in the case that, before wafer edge grinding by the grooves 132' and 134' of the fine-grinding wheels 132 and 134, a plurality of the grooves 132' and 134' formed on the surfaces of the fine-grinding wheels 132 and 134 need to be compensated, it is preferable to compensate the grooves 132' and 134' first. For example, if the groove 134 of the round fine-grinding wheel 134 for grinding the wafer edge is worn, a grinding position is changed to grind the wafer edge by another groove 134' formed on the round fine-grinding wheel 134. Therefore, in the case that the grooves 134' formed on the round fine-grinding wheel 134 are worn down, the worn grooves 134' are restored to the original state by the truing tool T2. In the same way, in the case that the groove 132' of the notch fine-grinding wheels 132 should be compensated, the groove 132' is compensated by the truing tool T1.

That is, as mentioned above, the truing tools T1 and T2 includes a first truing tool T1 for compensating the groove 132' of the notch fine-grinding wheel 132, and a second truing tool T2 for compensating the groove 134' of the round fine-grinding wheel 134. And, the truing tools T1 and T2 are operated by the truing operation unit 140 installed in the grinding apparatus 100.

The truing operation unit 140 aligns the edges of the first and second truers S1 and S2 to precisely contact the edges of the first and second truers S1 and S2 with the grooves 132' and 134' of the fine-grinding wheels 132 and 134, and rotates and move the first and second truers S1 and S2 towards the notch fine-grinding wheels 132 and the round fine-grinding wheels 134, respectively. At this time, the truing operation unit 140 includes a first truing operation unit 141 for operating the first truer S1 to contact the first truer S1 with the groove 132' of the notch fine-grinding wheel 132, and a second truing operation unit 142 for operating the second truer S2 to contact the second truer S2 with the groove 134' of the round fine-grinding wheel 134. The first and second truers S1 and S2 are mounted in the first truing operation unit 141 and the second truing operation unit 142 on a level with the groove 132' of the notch fine-grinding wheel 132 and the groove 134' of the round fine-grinding wheels 134, respectively. The first and second truers S1 and S2 compensate selectively separately or simultaneously the grooves 132' and 134' of the fine-grinding wheels 132 and 134 by the first and second truing operation units 141 and 142.

The first and second truing operation units 141 and 142 have the same elements, and only any one truing operation unit is described. For example, the second truing operation unit 142 includes a fixing means 145 for mounting the second truer S2, a motor 146 for rotating the second truer S2, a support 147 for fixing the motor 146, and a driving means 148 for moving the support 147. The second truer S2 is rotated by the motor 146, and moves to the groove 134' of the round fine-grinding wheel 134 by the driving means 148 and compensates the groove 134' of the round fine-grinding wheel 134. However, the second truing operation unit 142 is different from the first truing operation unit 141 in that the fixing means 145, the motor 146 and the support 147 of the second truing operation unit 142 are slanted at a predetermined angle in the same way as the helical wheel 134.

Figure 1:
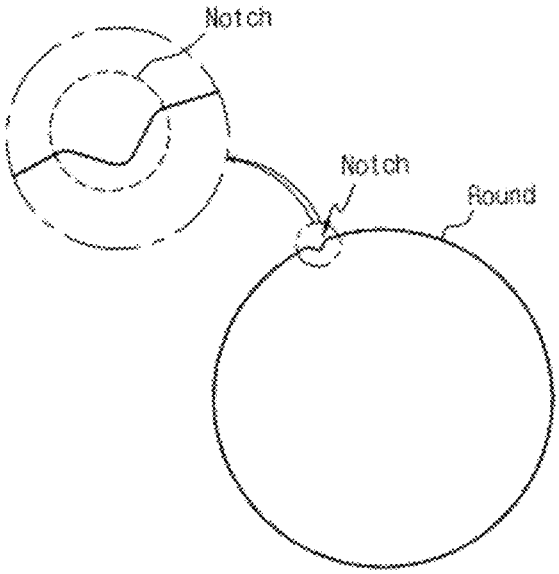
FIG. 1 is a view of a notch and a round of a wafer edge.
Figure 2:
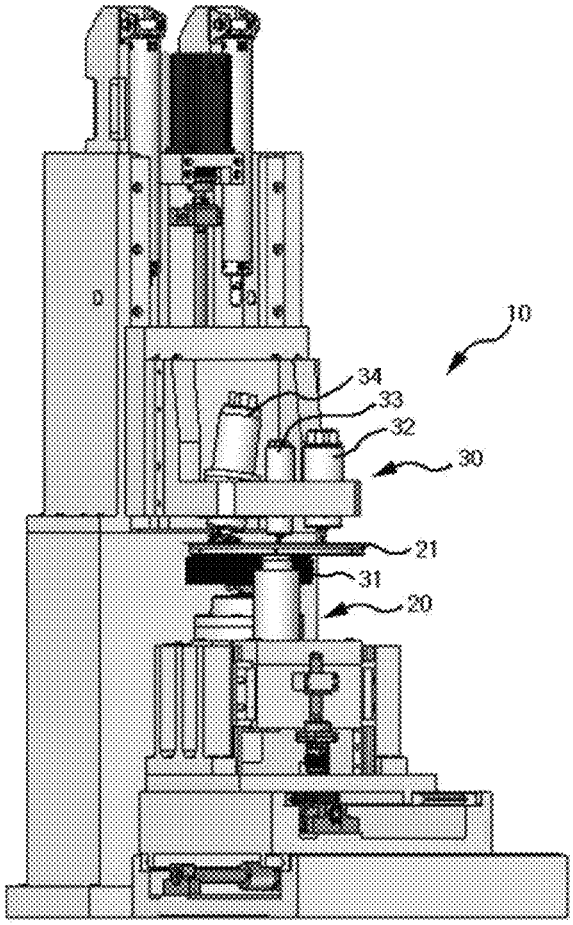
PRIOR ART FIG. 2
FIG. 2 is a view of a conventional wafer edge grinding apparatus.
Figure 3:
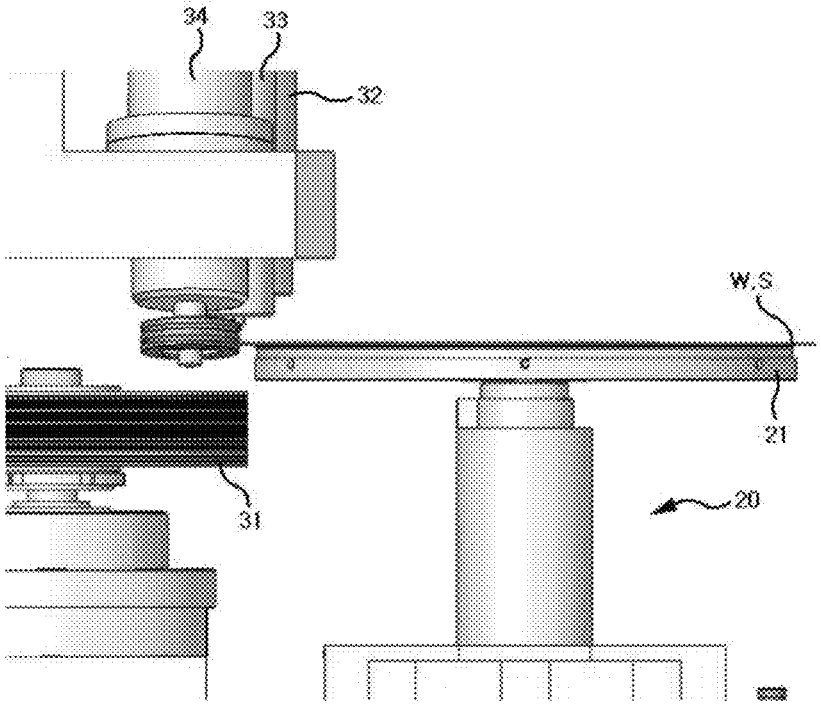
PRIOR ART FIG. 3
FIG. 3 is a partially enlarged side view of the grinding apparatus of FIG. 2.
Figure 4:
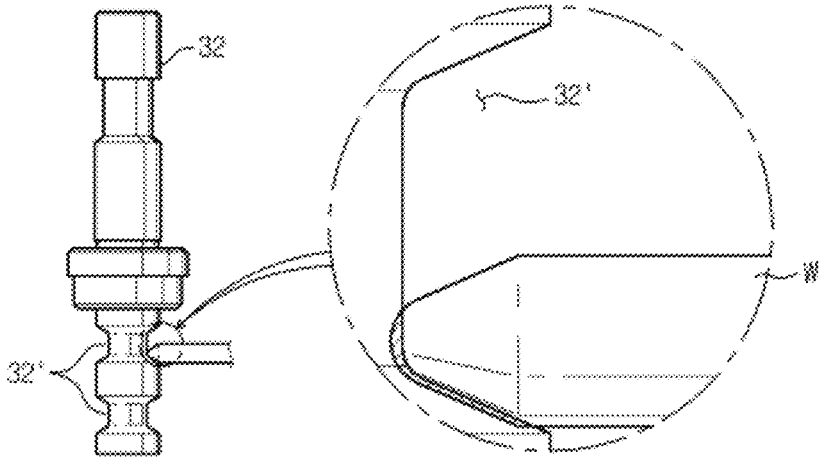
PRIOR ART FIG. 4
FIG. 4 is a side view illustrating wafer edge grinding by a conventional notch fine-grinding wheel.
Figure 4:
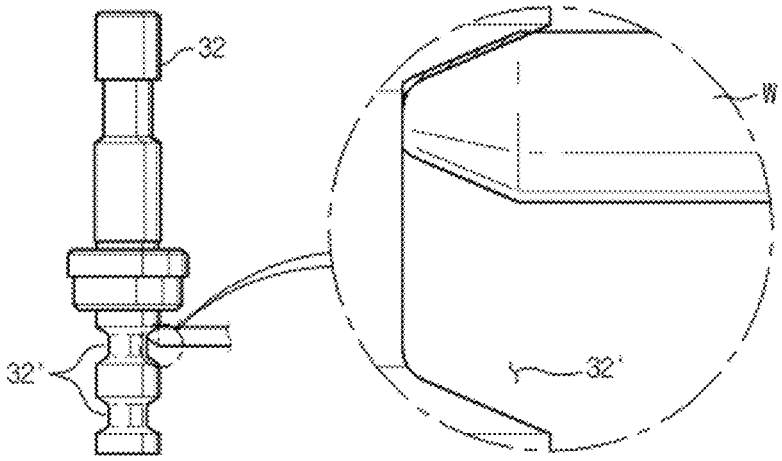
PRIOR ART FIG. 4
Figure 5:
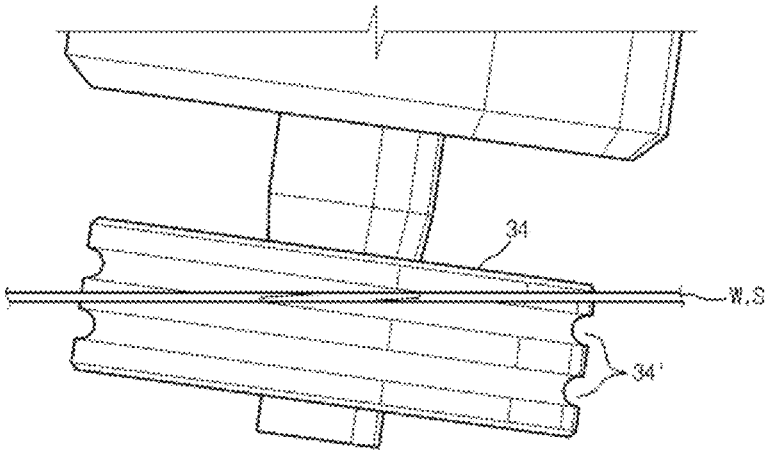
PRIOR ART FIG. 5
FIG. 5 is a side view illustrating wafer edge grinding by a conventional helical wheel.
Figure 6:
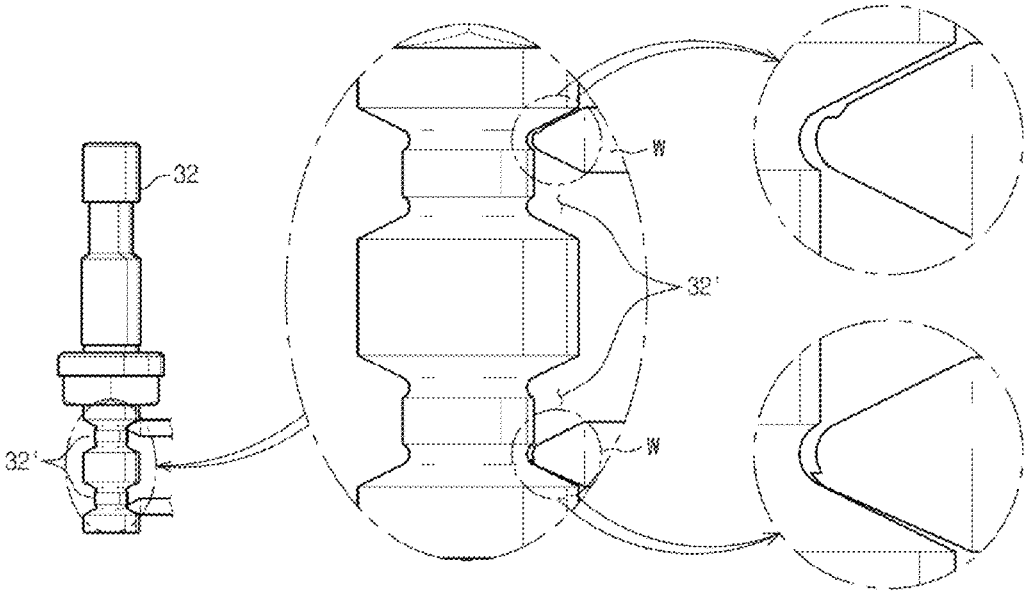
PRIOR ART FIG. 6
FIG. 6 is a view illustrating wear unbalance in a conventional wafer edge grinding.
Figure 7:
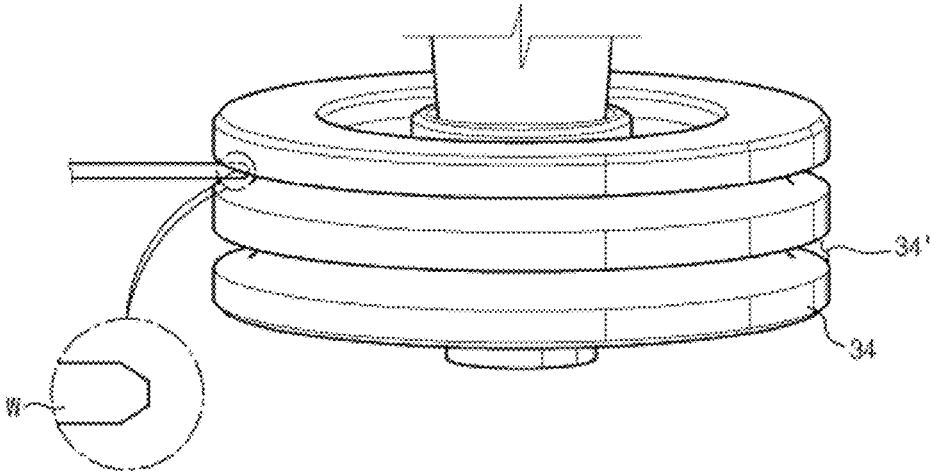
PRIOR ART FIG. 7
FIG. 7 is a view illustrating a faulty wafer resulted from a conventional wafer edge grinding without truing.
Figure 8:
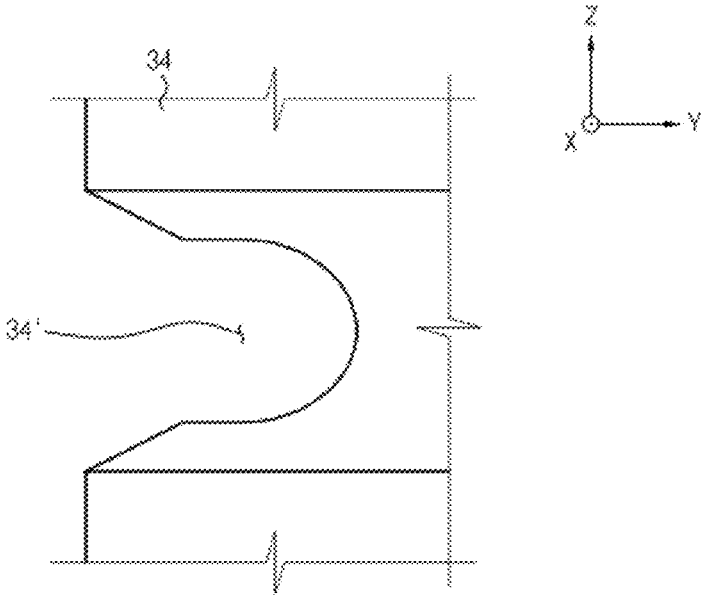
PRIOR ART FIG. 8
FIG. 8 is a view illustrating over-grinding caused by wear in a conventional wafer edge grinding.
Figure 8:
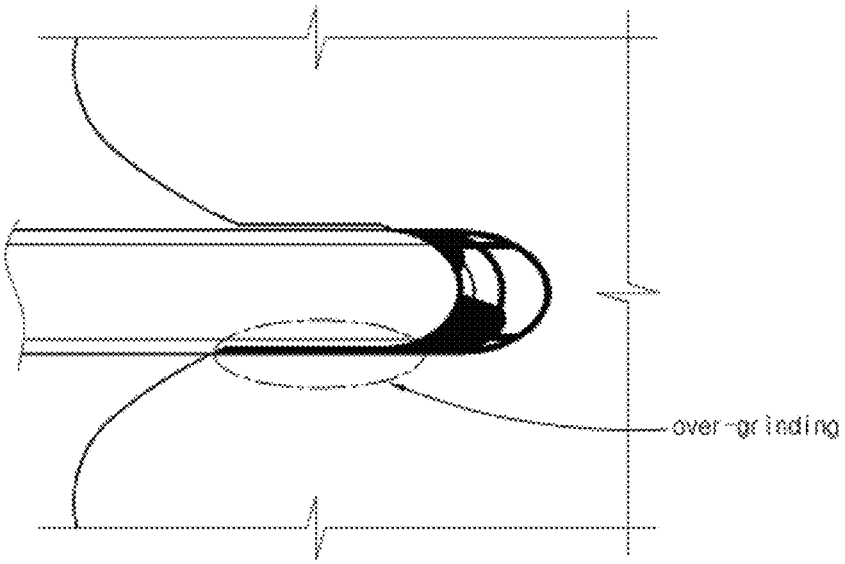
PRIOR ART FIG. 8

When compensating the groove 134', if a location coordinate of a point where the groove 134' is precisely contacted with the edge of the second truer S2 is stored in the control unit 150, it can reduce the time taken to start a normal grinding operation in a subsequent wafer edge grinding. That is, a coordinate (Y-axis and Z-axis in FIG. 8) of a location where the wafer edge is contacted with the grooves 132' and 134' of the grinding wheel 130 and a coordinate (Y-axis in FIG. 8) of a location where the edges of the truing tools T1 and T2 are contacted with the grooves 132' and 134' of the grinding wheel 130 are pre-stored in the control unit 150, and thus it needs only processing conditions of a Y-axis direction of the wafer edge and/or the edges of the truing tools T1 and T2 that is contacted with the grooves 132' and 134' of the grinding wheel 130, which makes it easy to set wafer processing conditions. Therefore, the likelihood of change in quality can be minimized and automatic compensation function can be realized. And, preferably the truing operation unit 140 for operating the truing tools T1 and T2 has a servo motor and an electronic scale for tracking a coordinate of a contact location so that the edges of the truing tools T1 and T2 are contacted with the grooves 132' and 134' of the grinding wheel 130 more precisely. The electronic scale and the servo motor are typical components used widely in the field of location and drive control, and detailed description is omitted.

After the grooves 132' and 134' of the grinding wheel 130 are compensated by the truing tools T1 and T2, the wafer edge grinding continues.

In the case that all grooves 132' and 134' of the grinding wheel 130 are worn out, the grinding wheel 130 is replaced by a new grinding wheel. At this time, the new grinding wheel can be easily installed using data of the stored location coordinate as mentioned above, and a Y-axis coordinate of a wafer can be found, so that a conventional manual process can be changed to an automatic process.

Meanwhile, although FIG. 15 shows the round fine-grinding wheel 134 uses a helical wheel, the present invention is not limited in this regard. The present invention may use a wheel disclosed in the Applicant's Korean Patent Application No. 10-2006-0138709 titled "wheel used for polishing edge part of semiconductor wafer".

Figure 18:
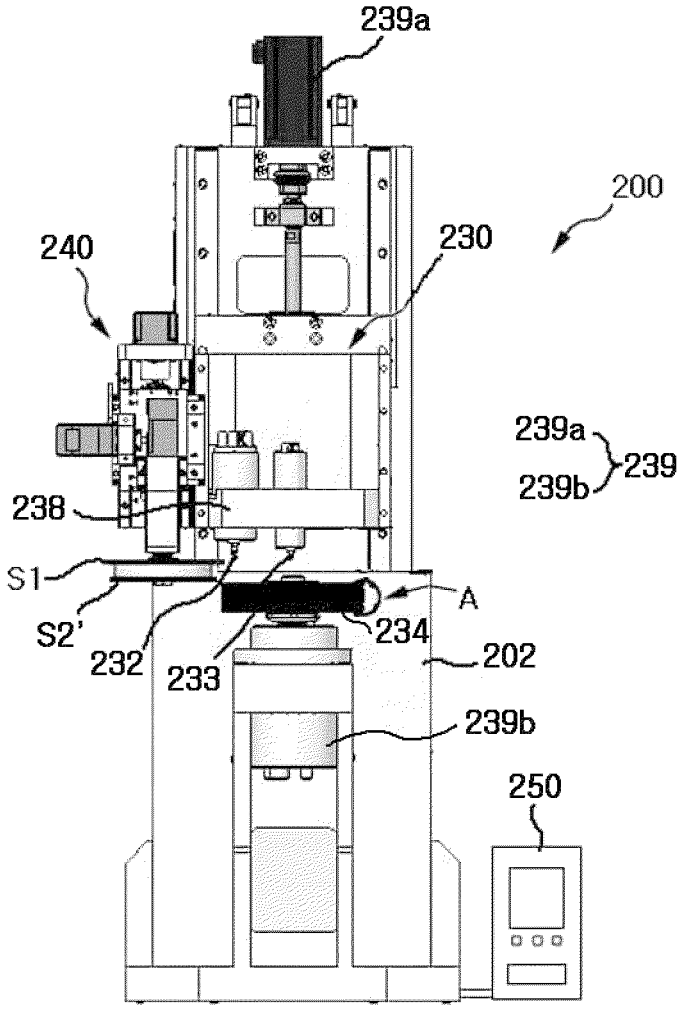
FIG. 18 is a view of a wafer edge grinding apparatus according to another preferred embodiment of the present invention.
Figure 19:
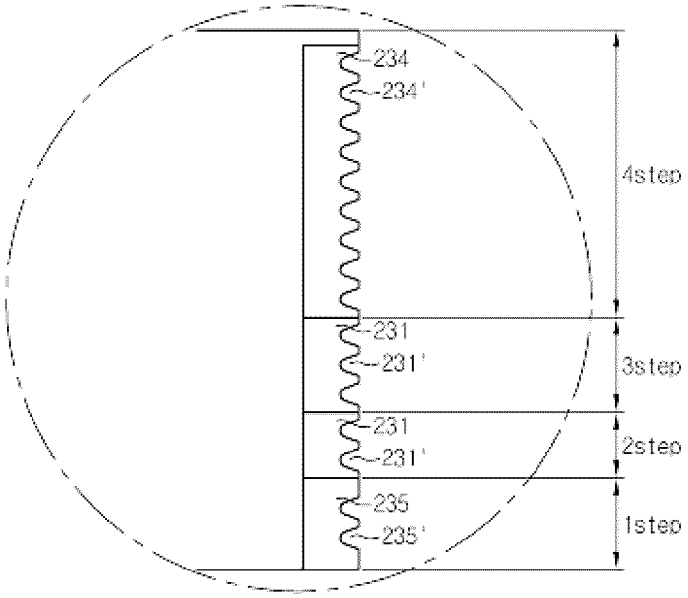
FIG. 19 is a partially enlarged view of section A of FIG. 18.

FIG. 18 is a view of a wafer edge grinding apparatus according to another preferred embodiment of the present invention. FIG. 19 is an enlarged view of section A of FIG. 18.

Referring to FIGS. 18 and 19, the grinding apparatus 200 according to this embodiment includes a chuck for mounting and rotating a wafer (W), a grinding wheel 230 for grinding an edge of the wafer (W), a grinding operation unit 239 for contacting a groove of the grinding wheel 230 with the wafer edge, a first truer S1 for compensating a groove of a notch fine-grinding wheel 232, a second truer S2' for compensating a groove of a round fine-grinding wheel 234, and a truing operation unit 240 for moving edges of the first truer S1 and the second truer S2' to contact the edges of the first truer S1 and the second truer S2' with the groove of the grinding wheel 230. At this time, the grinding apparatus 200 of FIGS. 18 and 19 has a similar structure to the grinding apparatus 100 of the above-mentioned embodiment. However, the grinding apparatus 200 of this embodiment is different from the grinding apparatus 100 of the previous embodiment in that the second truer S2' and the first truer S1 are installed in the truing operation unit 240, and a round rough-grinding wheel 231 and the round fine-grinding wheel 234 are mounted parallel with each other on the same rotation axis.

The grinding wheel 230 includes the round rough-grinding wheel 231, a notch rough-grinding wheel 233, the notch fine-grinding wheel 232 and the round fine-grinding wheel 234. Here, the notch rough-grinding wheel 233 and the notch fine-grinding wheel 232 are installed in and fixed to a wheel head assembly 238 of the grinding apparatus 200. The round rough-grinding wheel 231 and the round fine-grinding wheel 234 are mounted parallel with each other on the same rotation axis, and more preferably, they are mounted integrally with each other. The round fine-grinding wheel 234 is a vertical wheel that is mounted on a level with a plane comprising the surface of the wafer (W) and is rotated.

The grinding operation unit 239 includes a first grinding operation unit **239*a* and a second grinding operation unit 239*b*. The first grinding operation unit 239*a* rotates and moves the wheel head assembly 238 where the notch rough-grinding wheel 233 and the notch fine-grinding wheel 232 are mounted, so that the wafer edge is contacted with any one of grooves of the notch rough-grinding wheel 233 and the notch fine-grinding wheel 232. The second grinding operation unit 239*b* mounts, rotates and moves the round rough-grinding wheel 231 and the round fine-grinding wheel 234 so that the wafer edge is contacted with any one of grooves 231' and 234' of the round rough-grinding wheel 231 and the round fine-grinding wheel 234. At this time, the round rough-grinding wheel 231 and the round fine-grinding wheel 234 may be mounted parallel with each other or formed integrally with each other in the second grinding operation unit 239*b***.

The grinding operation unit 239 is a typical driving means that is moved by rotation of a belt, a pneumatic or hydraulic cylinder, a cam or a gear, for example a servo motor or a hydraulic motor, and the detailed description is omitted.

Meanwhile, the vertical wheel 234 rotated by the second grinding operation unit **239*b* has four steps. Specifically, the vertical wheel 234 has a first step where a truing groove 235' is formed, a second step and a third step where a groove 231' made of metal bond for rough-grinding a round of the wafer edge is formed, and a fourth step where a groove 234' made of resin bond for fine-grinding a round of the wafer edge is formed. Thus, the vertical wheel 234 can rough-grind and fine-grind the wafer edge. Here, the groove 234' of the fourth step for fine-grinding a round may be compensated or formed by the second truer S2'**.

The first truer S1 and the second truer S2' are mounted parallel with each other on the same rotation axis in the truing operation unit 240.

The truing operation unit 240 rotates and moves the first truer S1 and the second truer S2' to contact the first truer S1 and the second truer S2' with the groove of the notch fine-grinding wheel 232 and the groove 234' of the round fine-grinding wheel 234, respectively. At this time, the first truer S1 and the second truer S2' are rotated independently or simultaneously by the truing operation unit 240.

Further, in the same way as the above-mentioned embodiment, the truing operation unit 240 for operating the first truer S1 and the second truer S2' may have a servo motor and an electronic scale for tracking a location of a contact coordinate so that the edges of the first and second truers S1 and S2' are contacted with the groove of the notch fine-grinding wheel 232 and the groove 234' of the round fine-grinding wheel 234 more precisely.

Meanwhile, although this embodiment shows the vertical wheel 234 is used as a round fine-grinding wheel, however the present invention is not limited in this regard. The helical wheel (134 of FIG. 15) of the previous embodiment may be further installed in the grinding apparatus. In this case, a second truer (S2 of FIG. 15) is further installed to compensate and form a groove of the helical wheel.

Figure 20:
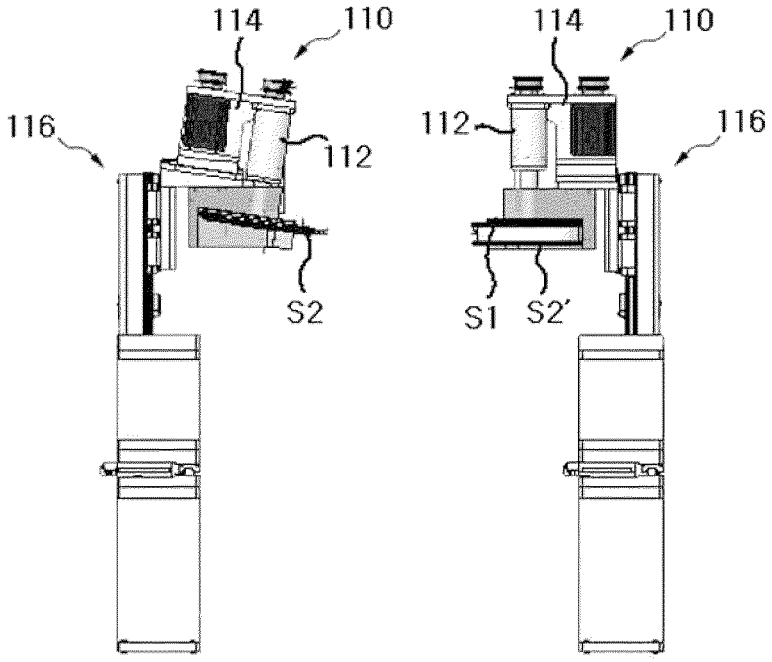
FIG. 20 is a view of a truing apparatus according to a preferred embodiment of the present invention.

As mentioned above, the grooves of the notch fine-grinding wheels 132 and 232 or the grooves of the round fine-grinding wheels 134 and 234 are compensated by the truing tool of the grinding apparatuses 100 and 200. However, the grooves may be compensated by an independent truing apparatus 110 of FIG. 20. And, the truing apparatus 110 can form grooves in the surfaces of a notch fine-grinding wheel and a round fine-grinding wheel having no groove, in conformity with wafer processing conditions. At this time, substantially the grooves are formed and reformed by a truing tool.

The truing apparatus 110 includes a first truer S1 and second truers S2 and S2'. The first truer S1 and second truers S2 and S2' are equal to the above-mentioned first truer S1 and second truers S2 and S2', and the detailed description is omitted. That is, the truing apparatus 110 rotates and moves the first truer S1 and second truers S2 and S2' to contact the first truer S1 and second truers S2 and S2' with the surface of a grinding wheel so as to form a groove in a notch fine-grinding wheel or a round fine-grinding wheel having no groove. For example, the truing apparatus 110 includes a motor 112 for rotating the first truer S1 and second truers S2 and S2', a plate 114 for fixing the motor 112, and a moving means 116 for moving the plate 114. It should be understood that the moving means 116 is a servo motor or a hydraulic motor that is moved by rotation of a belt, a pneumatic or hydraulic cylinder, a cam or a gear, and is configured to move the plate 114 to a predetermined location. Each element for rotating and moving the first truer S1 and second truers S2 and S2' of the truing apparatus 110 is a typical element, and the detailed description is omitted. However, it should be understood that the truing apparatus 110 including the above-mentioned elements forms grooves in the surfaces of a notch fine-grinding wheel and a round fine-grinding wheel for grinding a wafer edge and compensates the grooves. At this time, as mentioned above, the first truer S1 and the second truer S2' may be mounted parallel with each other on the same rotation axis.

Meanwhile, the truing apparatus 110 manufactures a notch fine-grinding wheel and a round fine-grinding wheel having a groove of the same conditions, keeps them, and when necessary, mounts a selected wheel in the grinding apparatuses 100 and 200. Thus, initial setting time required after a grinding wheel or its groove is replaced can be reduced.

It is obvious that the truing apparatus 110 may be used singularly or in combination with the grinding apparatuses 100 and 200.

Meanwhile, preferably the truing apparatus 110 is controlled by a control unit (150 of FIG. 15 and 250 of FIG. 18). The control units 150 and 250 each may have a button for manual operation, a storage unit for storing data, and a computer-based basic control system for providing a control signal and power to each operation unit and receiving a signal from a switch and other location/operation/contact signal generating sensor.

According to the present invention, a grinding wheel truing tool, its manufacturing method, and a truing apparatus, a method for manufacturing a grinding wheel and a wafer edge grinding apparatus using the same have the following effects.

First, the present invention maintains a shape of a groove of a grinding wheel to the original shape to solve a problem involving change in shape of wafer after processing that occurs due to wear unbalance. And, the present invention restores a burned groove resulted from truing, thereby improving durability of a grinding wheel.

Second, when compensating a groove, the present invention maintains a shape dimension (a radius of curvature of a round and an angle of a slanted surface) of the groove, and thus the present invention eliminates the likelihood that the groove is over-contacted with the edge of a wafer, thereby solving an over-grinding problem.

Third, the present invention solves an over-grinding problem to improve durability of a grinding wheel.

Fourth, when compensating a groove, a shape of the groove is maintained, and thus a parameter of wafer processing condition is limited to a Y axis, thereby easily setting the wafer processing conditions.

Fifth, when compensating a groove of a grinding wheel by a truing operation unit, the present invention can identify a Y coordinate of a wafer in advance to reduce an equipment down time spent from truing to normal grinding operation. Thus, the present invention can change a manual compensation of a grinding wheel to an automatic compensation.

Sixth, the present invention forms and reforms a groove of the same standard dimension of grinding by use of a truing apparatus capable of utilizing a truing tool, thereby reducing an initial setting time required after a grinding wheel or its groove is replaced by a new one.

Seventh, the present invention manufactures a grinding wheel truing tool using a shape dimension of its edge to reduce an equipment down time spent from replacement of a truing tool or a grinding wheel to normal operation.

Hereinabove, preferred embodiments of the present invention has been described in detail with reference to the accompanying drawings. However, it should be understood that the detailed description and specific examples, while indicating preferred embodiments of the invention, are given by way of illustration only, since various changes and modifications within the spirit and scope of the invention will become apparent to those skilled in the art from this detailed description.

What is claimed is:

1. A method for manufacturing a truer for compensating a groove of a round fine-grinding wheel for fine-grinding a round of a wafer edge, comprising:

(a) on a three-dimensional construction program, forming a groove in the shape of an edge of a completed wafer at a portion of an outer periphery of a cylindrical subject with a shape dimension of the round fine-grinding wheel having no groove, the cylindrical subject having a central axis slanted at a predetermined angle;

(b) through computer simulation, rotating the cylindrical subject based on the central axis to expand the wafer edge-shaped groove along the outer periphery of the cylindrical subject;

(c) obtaining a shape dimension of the expanded groove as a shape dimension of an edge of the truer; and (d) manufacturing the truer using the obtained shape dimension.

2. The method for manufacturing a truer according to claim 1, wherein, in the step (c), the shape dimension of the edge of the truer is obtained by extending a slanted surface of the expanded groove along the slanted surface such that a thickness of the truer is larger than a width of the groove.

3. The method for manufacturing a truer according to claim 1, wherein the step (d) manufactures the truer as a diamond wheel by electroplating or metal bonding.

* * * * *